United States Patent [19]

Mayston

[11] 3,946,588

[45] Mar. 30, 1976

[54] METHODS OF AND APPARATUS FOR EDGE-FORMING METALLIC PLATES

[75] Inventor: Donald Mayston, St. Albans, England

[73] Assignee: Protocol Engineering Limited, England

[22] Filed: Nov. 14, 1974

[21] Appl. No.: 523,901

[30] Foreign Application Priority Data

Nov. 28, 1973 United Kingdom ..... 55244/73

[52] U.S. Cl. ..... 72/465; 72/379

[51] Int. Cl.[2] ..... B21D 19/00

[58] Field of Search ..... 72/312, 319, 320, 465, 72/60, 379, 310

[56] References Cited

UNITED STATES PATENTS

| | | | |
|---|---|---|---|
| 3,009,201 | 11/1961 | Hansen | 72/322 |
| 3,213,992 | 10/1965 | Gustafson et al. | 192/134 |
| 3,258,948 | 7/1966 | Carlson | 72/465 |
| 3,610,017 | 10/1971 | Harris | 72/421 |
| 3,662,584 | 5/1972 | Jones | 72/321 |
| 3,733,872 | 5/1973 | Gregoire | 72/213 |
| 3,777,529 | 12/1973 | Kaufmann | 72/465 |
| 3,786,666 | 1/1974 | York | 72/320 |
| 3,815,393 | 6/1974 | Daniels | 72/320 |
| 3,817,075 | 6/1974 | Marsh et al. | 72/319 |

*Primary Examiner*—Michael J. Keenan
*Attorney, Agent, or Firm*—Brisebois & Kruger

[57] ABSTRACT

At least one die pad made of a resilient flowable material is pressed against a metallic plate located on a former with at least one edge projecting beyond an adjacent edge of the former and is turned around the adjacent former edge whilst maintaining the pressure to cause the projecting edge of said plate to conform to the shape of said adjacent former edge and thereby edge-form the metallic plate.

15 Claims, 17 Drawing Figures

Fig.1
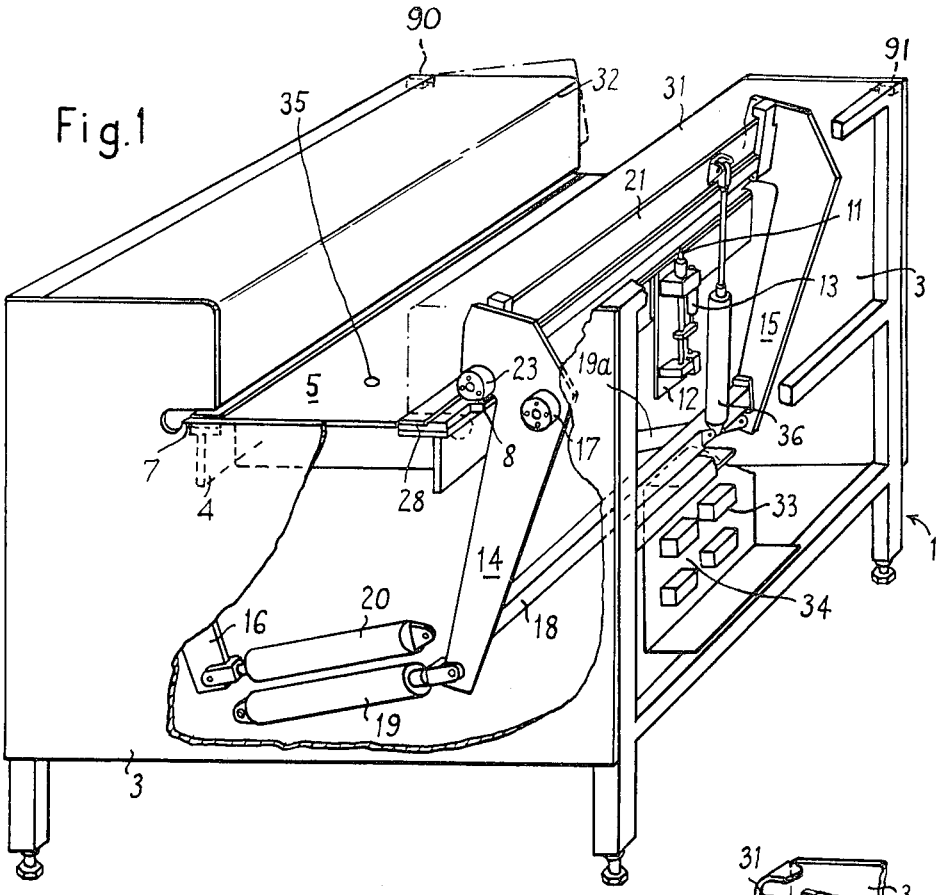
Fig.7
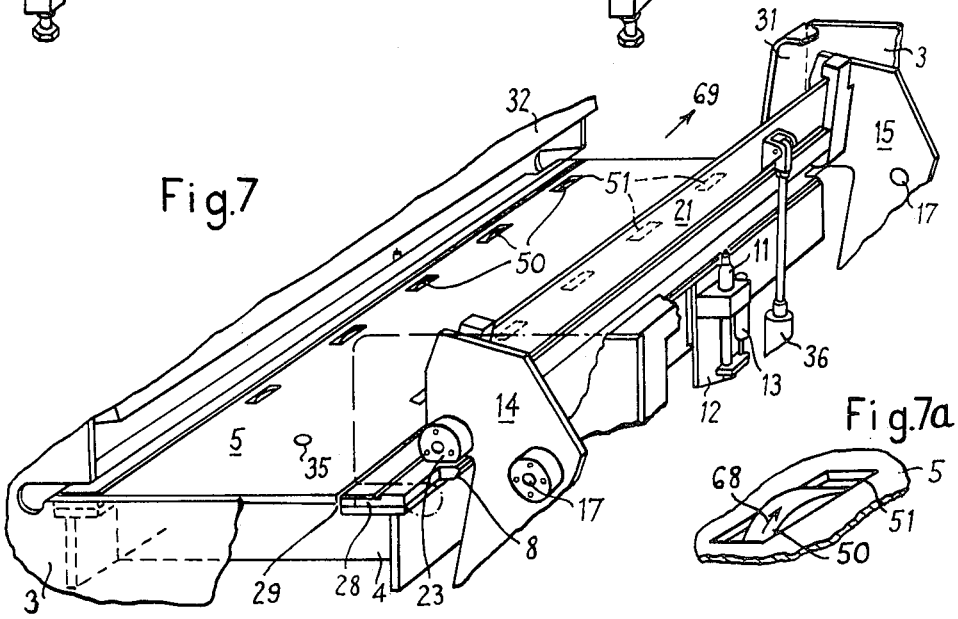
Fig.7a

Fig.4a
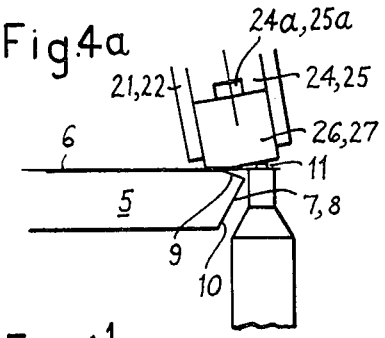
Fig.4d
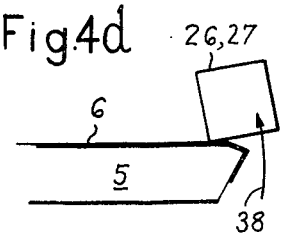
Fig.4b
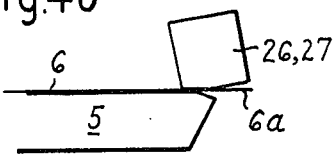
Fig.4e
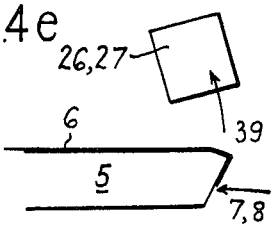
Fig.4c
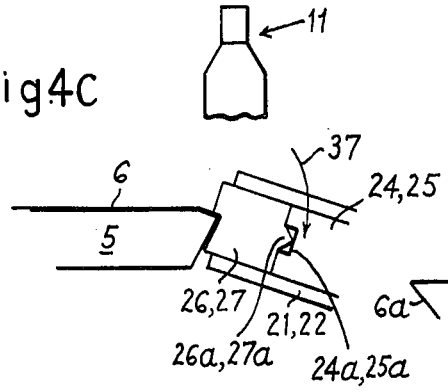
Fig.4f
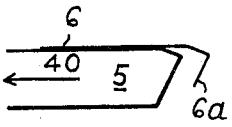
Fig.4g
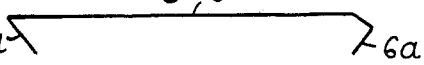
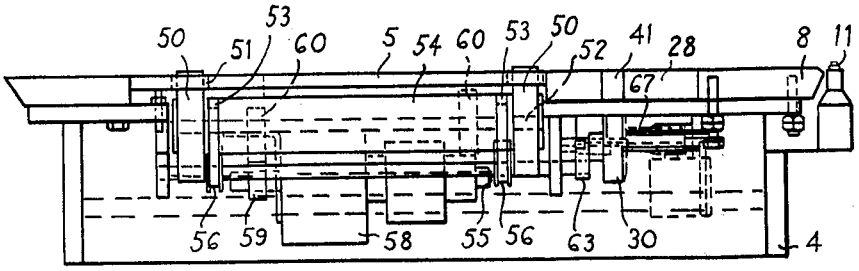
Fig.9

METHODS OF AND APPARATUS FOR EDGE-FORMING METALLIC PLATES

BACKGROUND OF THE INVENTION

1. Field of the Invention

This invention relates to methods of and apparatus for edge-forming metallic plates and more particularly but not exclusively relates to the edge-forming of lithographic plates, and metal-backed letter press plates.

2. Description of the Prior Art

In the preparation of lithographic plates for printing usually two opposite edges of the plate are bent-over for insertion in the wells of a printing drum of a rotary offset lithographic printing machine, where the bent-over ends are engaged by clamping means to secure the plate to the drum. In such cases it is necessary that the edge forming operation provides a plate having accurately formed edges, which is not deformed and/or stressed and which is not abraded and in which the formed edges are in precise relationship to the image. In one known edge forming machine in which metal beams are used to form the edges of the plate, about a metal former, such precision in formed edge/image relationship cannot be ensured. This is because the metal beams are subjected to slight bending during edge-forming, and the machine to wear of its parts such as the metal beams and bearings and former thereby increasing play with time and producing inconsistent results. If for example it is necessary to replace one of a plurality of lithographic plates which print together on the same printing cylinder, after some time has elapsed, then because of wear and deformation of the machine the edge-formed edges of the fresh plate usually have a different formed edge/image relationship to the replaced plate and to the other plates, resulting in out-of-register printing. Moreover, any inaccuracies, deformations or stresses in a particular lithographic plate caused during edge-forming will result in displacement of the photographic image when the plate is secured to the printing drum and thus also in out-of-register printing. Furthermore, any abrasion of the plate can remove the photographic emulsion from the printing surface of the plate. Thus, it is not possible with such apparatus to ensure that for large numbers of lithographic plates the formed edge/image relationship will be precise for each particular plate and the same for every plate.

Accordingly it is an object of this invention to provide a method of and apparatus for edge-forming metallic plates, in which the aforesaid disadvantages are minimized or eliminated.

SUMMARY

From one aspect invention invetion consists in a method of edge-forming metallic plates, comprising the steps of clamping a metallic plate on a former in a located position in which an edge of the plate projects beyond an adjacent edge of the former, by means of a die pad made of a resilient, flowable material which contacts the plate adjacent said former edge, and turning said pad around said former edge in contact with said plate edge whilst simultaneously compressing the pad against said former edge causing said plate edge to conform with the shape of the edge of the former.

From another aspect the invention consists in apparatus for edge-forming a metallic plate, said apparatus comprising a former plate for receiving a metallic plate and having a first die part constituted by an edge of said former plate, a second die part comprising a pad made of a flowable resilient material, means for pressing the pad against the former and means for turning said pad around said first die part whilst said pressure is maintained to cause the material of said pad to conform to the shape of said first die part.

The nature of the material of the second die part is such that as the pad is turned around and compressed against the first die part, the plate edge and the first die part are pressed into the pad material which flows to conform to the shape of the first die part and such that when the edge-forming and clamping pressure is released, the deformed pad returns to its original shape.

The material of the pad may be any suitable plastics, natural or synthetic rubber, rubber-like or elastomeric material but is preferably a urethane elastomer or rubber. The most suitable material known to us at this time is that marketed by the Du Pont Company (United Kingdom) Limited under the Trade Mark ADIPRENE CM. which is a sulphur curable polyether urethane rubber.

In a preferred embodiment of the invention the die pad is mounted in a channel of a beam extending parallel to the former edge, the beam mounted to rotate about a substantially horizontal axis. The beam is conveniently mounted on and extends between two double armed levers such as bell cranks which are movable by a prime mover between a position in which the pad clamps the metallic plate to the former and a non-clamping position in which the pad is spaced from the former.

In the clamping position of the bell-crank levers, the beam is rotatable by another prime mover to turn the pad around the first die part whilst causing the pad to compress the plate edge against the first die part.

The prime movers may be pressure fluid operated means or the bell crank levers and beam may be adapted for manual operation.

Preferably, means are provided for automatically and sequentially controlling the edge-forming operation.

If necessary additional clamping means may be provided on each of the bell-crank levers.

Depending on the purpose for which the edge-formed plate is required the apparatus may be adapted to provide an edge form comprising one or a plurality of bends.

BRIEF DESCRIPTION OF THE DRAWINGS

Embodiments of the invention will now be described, by way of example, with reference to the accompanying drawings, in which:

FIG. 1 is a perspective view, with parts broken away, of an apparatus for edge-forming lithographic plates, FIGS. 4A to 4G are diagrammatic representations of the sequence of operations of the edge-forming apparatus, FIG. 7 is a perspective view of a part of another embodiment, FIG. 7*a* is a scrap view of FIG. 7, FIGS. 8 and 9 are plan and end views respectively of the embodiment of FIG. 7.

DESCRIPTION OF THE PREFERRED EMBODIMENTS

Figure 3:
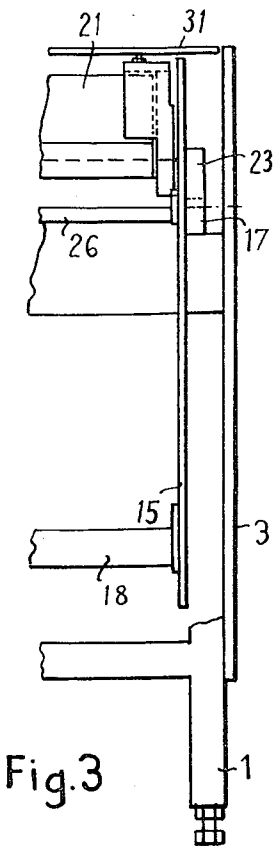
FIG. 3 is a part side view of FIG. 2 looking in the direction of the arrow.
Figure 2:
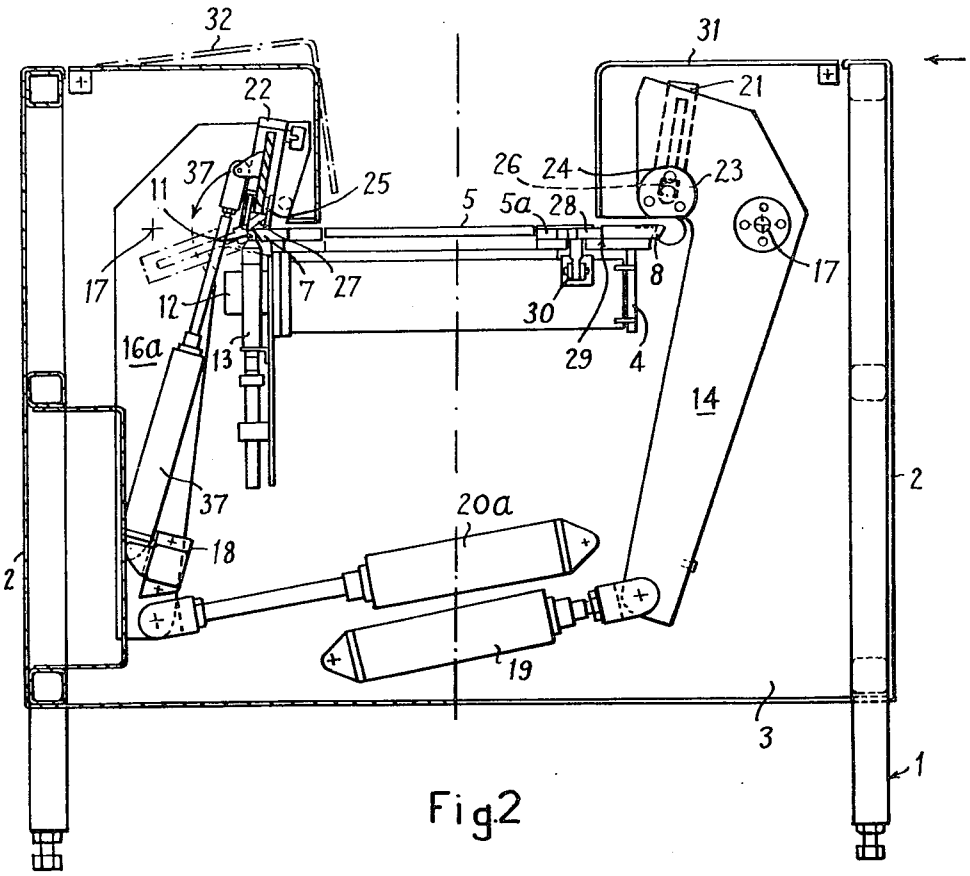
FIG. 2 is an enlarged part-sectional end view with parts removed of the apparatus of FIG. 1.

Referring to FIGS. 1 to 3 of the drawings, the edge-forming apparatus illustrated comprises a supporting structure in the form of a frame, generally indicated at 1, to which frame are secured side panels 2 and end panels 3, one of the end panels 3 being partly broken away in FIG. 1 and being removed in FIG. 2 and one of the side panels being removed in FIG. 1 for clarity of illustration. Mounted on the frame 1 is a table 4 which supports a former plate 5 for receiving a lithographic plate 6 which is partly shown in FIG. 4. The apparatus illustrated comprises means for bending two opposite edges of the lithographic plate although, it will be appreciated that the apparatus may be used for, or, comprise means for, edge-forming one edge only. The former plate 5 is fixed to the table 4 by appropriate means, not shown, and the opposite, right-hand and left-hand, as illustrated, edges constitute first die parts 7 and 8 respectively which cooperate with second die parts to be described for edge-forming the edges of the lithographic plate 6. Typically and as shown the first die 8 has two angled portions 9 and 10 as is more clearly shown in FIG. 4, and the first die part 7 has only one angled portion. The first angled portion 9 is angled at 160° C with respect to the upper surface of the former plate, the second portion 10 being angled at 90° with respect to the first portion, whereas the angled portion of the die part 7 is angled at 110° with respect to the upper surface of the former plate.

Means for locating the lithographic plate 6 on the former plate 5 comprises register pins 11 mounted in housings 12 which are secured to opposite sides respectively of the table 4 adjacent to the respective die parts 7 and 8. The register pins 11 are movable upwardly and downwardly by pneumatically-operated double-acting piston and cylinder devices 13 mounted on the housings 12 into positions in which the pins project a short distance beyond the upper edge of the adjacent die part 7, 8 as will be more clearly apparent from FIGS. 1 and 4, and positions in which the register pins are located beneath the upper surface of the adjacent die parts respectively (see FIGS. 2 and 4).

Disposed on opposite sides respectively of the table 4 adjacent the die parts 7 and 8 is provided means for edge-forming the lithographic plate 6 and comprising two pairs of bell-crank levers of which one pair 14 and 15 are shown at the right hand side, as illustrated, of the table in FIG. 1 and of the other pair mounted on the left hand side of the table 4, as illustrated, part only one bell-crank lever 16 is shown in FIG. 1. The other bell-crank lever of the other pair is designated **16*a* and is shown in FIG. 2. Each of the bell-crank levers is rotatable about an axis which extends parallel to the associated die part 7, 8 on respective pivots 17 supported on an adjacent end plate 3. The downwardly extending, lower, arms of the bell-crank levers are rigidly interconnected by respective beams 18 and are each operable by respective pneumatically operated double-acting piston and cylinder devices. Piston and cylinder devices 19, 19*a* and 20, 20*a* are connected at one of their ends to the respective lower arms of the bell-crank levers 14, 15 and 16, 16*a*. At their other ends the devices 19, 19*a* and 20, 20*a* are connected to the respective end panels 3. To the other arms of the bell-crank levers of the respective pairs of bell-cranks are connected forming beams 21, 22 extending parallel to the associated die part 7, 8 and being rotatable about a substantially horizontal axis extending parallel to the associated die part 7, 8 to bend the edges of the lithographic plate about the die parts. The beams 21, 22 are connected to the upper arms of the respective pairs of bell-crank levers by means of pivots 23 about which the beams are rotatable. Referring particularly to FIG. 2 each beam is provided with a channel 24, 25 into which a second die part consisting of a pad 26, 27 is securely mounted. As shown in FIG. 4*a* space 24*a*, 25*a* is left between the bottom of the channel 24, 25 and the die pad 26, 27 for a purpose to be explained. The die pads 26 and 27 extend the full length of the beams in their respective channels and are made of a flowable, resilient plastics material. The beams 21, 22 are rotated about the pivots 23 by pneumatically-operated piston and cylinder devices 36, 37 connected between the beams 18 and the beams 21, 22 so that the beams 21, 22 can move with the bell crank levers. Actuation of the piston and cylinder devices 19, 19*a* and 20, 20*a* connected to the bell crank levers, causes the bell crank levers to rotate into the position shown by the bell crank lever 16*a* in FIG. 2, the piston arm of the device 20*a* being extended. In this position the pads 26, 27 press against the upper surface of the die parts 7 and 8 respectively to clamp the lithographic plate 6 to the former plate when the plate 6 is mounted thereon. A wedge system 28 extending lengthwise of the table in a recess 29 is disposed between the die part 8 and the remaining portion of the former plate 5**.

Figure 5:
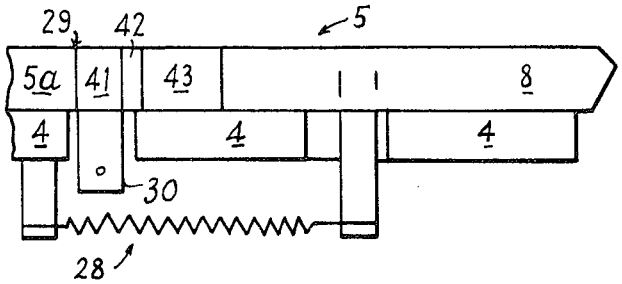
FIGS. 5 and 6 are diagrammatic views of a wedge system for plate removal.
Figure 6:
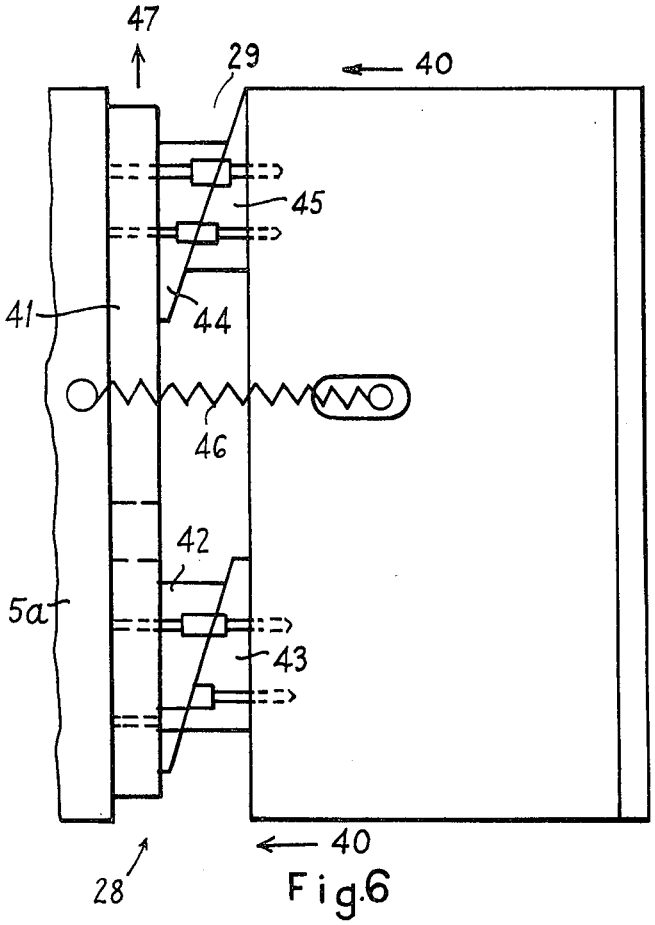

The wedge system 28 is movable in the recess 2 by a pneumatically operated double-acting piston and cylinder device 30 mounted underneath the table 4 to decrease the dimension of the former plate between the die parts 7 and 8 for the purpose of removing an edge-formed lithographic plate. As shown in FIGS. 5 and 6, the wedge system 28 comprises an elongate member 41 which is movable in the direction of the arrow 47 by the device 30. Co-operating wedges 42, 43 and 44, 45 are fixed to the member 41 and the movable die part 8 of the former respectively as illustrated. One or more springs such as 46 are connected between the fixed and movable former parts **5*a* and 8 to cause the die part 8 to move in the direction of the arrow 40 when the device 30 is operated. Typically, the movement of the wedges reduces the width of the former plate 5** by about 7 mm.

A pair of guards 31, 32 are mounted on respective side panels 2 and are pivotable into an open position for mounting a lithograhic plate on the former plate 5 and into a closed position to actuate switching means 90, 91 for initiating operation of the apparatus in a manner to be described. The guards are transparent to facilitate location of the lithographic plate to the register pins 11.

Control valves 33 are mounted on a support 34 fixed to the frame 1, the control valves 33 being connected by suitable air lines to the respective various piston and cylinder devices, and to the switching means, for operating the bell-crank levers, the register pins the wedge system and effecting rotation of the forming beams.

A reset button 35 recessed in the upper surface of the former plate 5 is accessible with the lithographic plate removed. There are four valves 33 one for the operation of the bell crank levers, a second for rotation of the beams 21, 22 a third for the operation of the register pins 11 and a fourth for the operation of the wedge 28.

Figure 8:
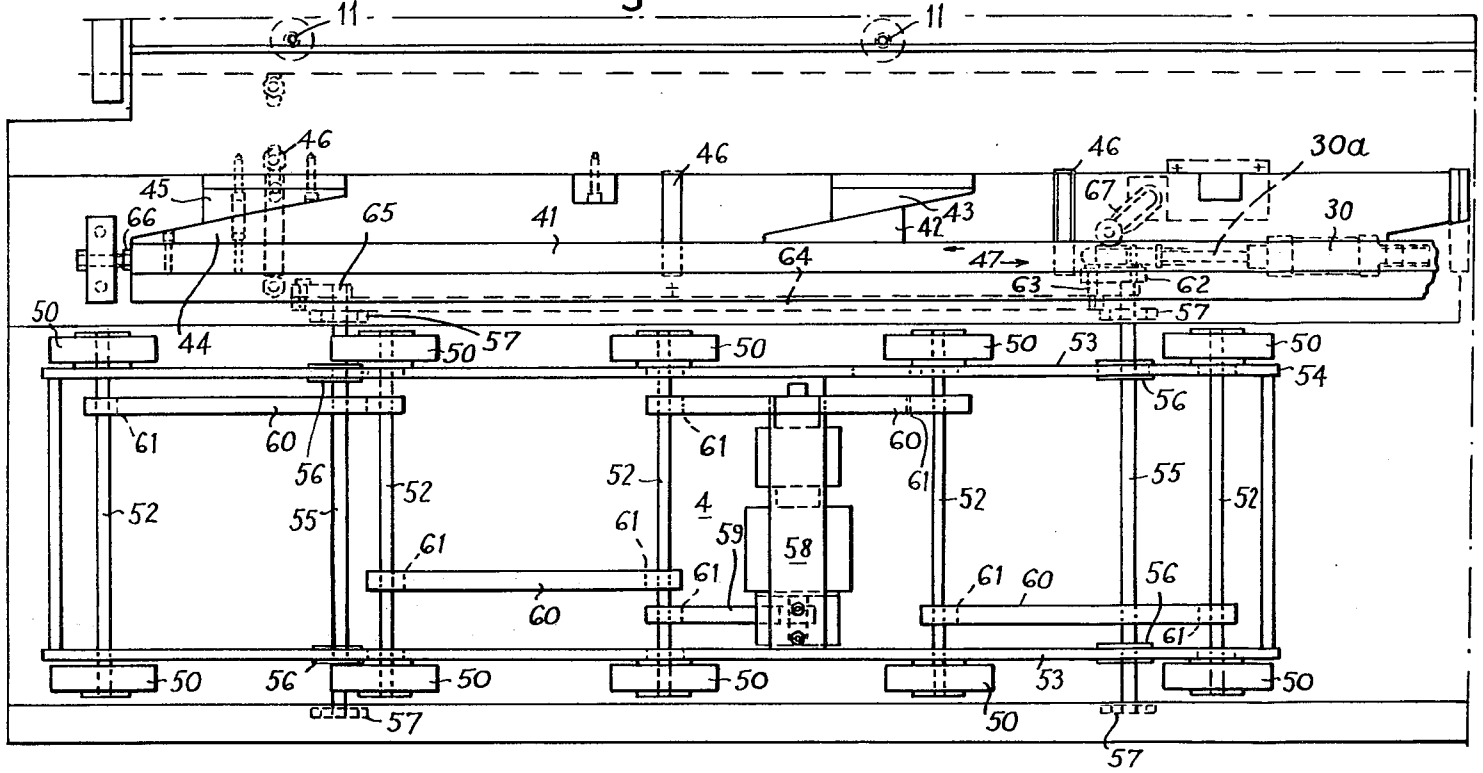

The embodiment of FIGS. 7 to 9 differs from that of FIGS. 1 to 6 in that it is provided with a system for automatically removing or taking-off the edge-formed lithographic plates from the former plate 5 when the wedge system 28 is operated. Otherwise the embodiment of FIGS. 7 to 9 is substantially the same.

Referring to FIGS. 7 to 9 such an automatic system comprises 10 wheels 50 which project from beneath into apertures or slots 51 in the former plate 5 and which the wheels 50 are conveniently made from rubber or plastics or are rubber or plastics surfaced. The wheels 50 are mounted in pairs on respective shafts 52 rotatably mounted in suitable bearings in the side members 53 of a sub-frame 54 supported beneath the former plate 5 from the table 4. The support for the sub-frame 54 is provided by rotatable shafts 55 having eccentrics 56 (two fixed to each shaft 55) which engage in suitably shaped bearing housings in the side members 53 of the sub-frame. At each of their ends, the shafts 55 are mounted in static bearings 57 carried by the table 4.

The shafts 52 carrying the wheels 50 are driven by means of an air motor 58 via a drive belt 59 and toothed belts 60 interconnecting the shafts and engaging with sprocket wheels 61 mounted thereon. The drive belt engages with a similar sprocket wheel 61 on one of the shafts 52. The sub-frame 54 is movable upwardly and downwardly between positions in which the wheels 50 project slightly above the surface of the former plate 5, i.e. in the position illustrated in FIG. 9 and another position in which the wheels are retracted within the slots 51 and lie beneath the surface of the former plate. The piston and cylinder device 30 for operating the wedge system 28 via its piston rod 30*a* connected to the elongate member 41 is also operative to move the sub-frame 54 upwardly and downwardly. Thus, retraction of the piston rod 30*a* moves the elongate member 41 in the direction of the arrow 47 to reduce the dimension of the former plate between the die parts 7, 8 and raises the wheels into the position shown in FIGS. 7*a* and 9. Extension of the piston rod displaces the member 41 in the opposite direction and the sub frame and wheels are lowered into the position shown in FIGS. 7 and 8. The piston rod 30*a* is connected to the right hand, as illustrated, shaft 55 via a link 62 and a lever 63 which is rigidly fixed to this shaft. The lever 63 is connected via a connecting rod 64 and another similar lever 65 to the left-hand shaft 55 as illustrated. The elongate member 41 cooperates with an end of travel adjustable stop 66 to prevent overtightening of the wedges 42 to 45 of the wedge system 28. As the piston rod 30*a* is retracted or extended the movement of the rod 30*a* actuates a motor switch 67 which switches the motor 58 on or off as the case may be by supplying or stopping supply of air to the air motor through the valve 33 for the device 30. Actuation of the reset button 35 after the edge-formed lithographic plate has been removed causes air to be supplied to another chamber of the device 30 to cause extension of the piston rod 30*a*.

The operation of the apparatus will now be described with particular reference to FIGS. 4A to 4G and to FIG. 2. It will be apparent that each pair of bell-crank levers operates in the same manner and that both pairs of levers operate together. With the guards 31 and 32 raised, a lithographic plate 6 is mounted on the former plate 5 so that the opposite edges 6*a* project beyond the die parts 7 and 8 and so that register pin holes (not shown) in the edges of the plate are engaged with the register pins 11 which project for a short distance beyond the upper surface of the former plate as will be apparent from FIG. 4A. Engagement of the pins 11 in the register pin holes locates the plate 6 on the former plate 5. The bell-crank levers are in the position of the lever 14 in FIGS. 1 and 2 at this stage of operation, in which there is a gap between the lower edges of the levers and the upper surface of the former plate sufficient for the lithographic plate to be located on the register pins. The guards 31 and 32 are then pivoted into their closed positions to actuate the switching means and initiate opening and closing of the valves 33 in a sequential fashion so that each step in the edge-forming process follows one after the other.

The pairs of bell crank levers are first actuated by air supplied through an associated valve 33 to their respective piston and cylinder devices 19, 20 to cause the bell crank levers to rotate into a position in which the front edges of the pads 26, 27 exert a pressure on the lithograhic plate 6 at a location adjacent the die parts 7 and 8 to clamp the lithographic plate 6 to the former plate 5. As will be apparent from FIG. 4A the front edge of the pad 26, 27 is deformed due to the pressure exerted by the bell cranks. On the other hand the rear portion of the pad 26, 27 is located just above and clears the register pin 11 in the clamped position. Once clamping has taken place the valve for the piston and cylinder devices 13 is opened to supply air to the piston and cylinder devices 13 causing the register pins 11 to be retracted into the position shown in FIG. 4B, beneath the former plate 5. The bell crank levers then occupy the position of the bell-crank lever 16*a* in FIG. 2.

Another valve 33 is then opened to supply air to the devices 36 and 37 causing the beams 21, 22 to be rotated with respect to the bell crank levers. Thus the pads 26, 27 are turned around the die parts 7 and 8 in the direction of the arrow 37 in FIG. 4C and FIG. 2. As the pads are turned about the die parts 7 and 8 the bellcrank levers press and maintain the pads in contact with the projecting edges 6*a* of the plate 6 at the bending angle and throughout the entire area of the bend and, the pads are compressed against the die parts 7 and 8 so that the material of the pads flows and is deformed into a shape corresponding to that of the die parts 7 and 8 and thus the edges 6*a* are conformed to the shape of the die parts 7 and 8 and the inside radius of the bend in each edge is controlled. In their fully rotated position the beams occupy the dotted line position shown in FIG. 2. As shown in FIG. 4C the space 24*a*, 25*a* at the bottom of the channel 24, 25 in the beam 21, 22 provides relief for the material 26*a*, 27*a* displaced by the deformation of the pad 26, 27.

It will be appreciated that the valves 33 operate in sequence until the plate is edge-formed. At the end of the edge-forming operation firstly the beams 21 and 22 are rotated in the direction of the arrow 38 in FIG. 4D, then as shown in FIG. 4E the bell cranks are rotated to raise pads 26, 27 in the direction of the arrow 39 so that the bell cranks occupy the position of the bell crank 14 in FIG. 2 and the pads occupy the position shown in FIG. 4E.

The valve 33 for the piston and cylinder device 30 is then opened to operate the wedge system 28 causing the die part 8 to move in the direction of the arrow 40 in FIG. 4F towards the die part 7 to permit removal of the edge formed plate 6 without damage. In the case of the embodiment of FIGS. 7 to 9, supply of air to one chamber of the piston and cylinder device 30 causes the sub frame 34 to be moved into its upper position as the piston rod 30*a* is retracted, via link 62, lever 63, connecting rod 64, lever 65, shafts 55 and eccentrics 56. The motor switch 67 is actuated as the piston rod 30*a* is retracted starting the motor 58 which rotates the wheels 50 in the direction of the arrow 68 (FIG. 7*a*) whereby an edge-formed lithographic plate is automatically removed from the former plate in the direction of the arrow 69 (FIG. 7) by the action of the wheels 50 engaging with its undersurface. The safety guards 31, 32 are then opened, shutting-off the apparatus and the edge-formed plate 6 shown in FIG. 4G is then removed from the former plate 5. The reset switch 35 is then actuated to open the valve for the device 30 and bring the wedge system 28 and thus the die part 8 to its original position for another edge-forming operation and also to operate the cylinder 13 to raise pins 11.

In the case of the embodiment of FIGS. 7 to 9 when the reset switch 35 is actuated, extension of the piston rod 30*a* actuates the motor switch 37 causing shutting-off of the air supply to the motor 58 and thus stopping rotation of the wheels 50. At the same time via the link, levers connecting rod, shafts and eccentrics, the sub-frame 54 is lowered into the position in which the wheels lie below the surface of the former plate 5 and the former plate 5 is ready to receive another lithographic plate to be edge-formed.

Figure 10:
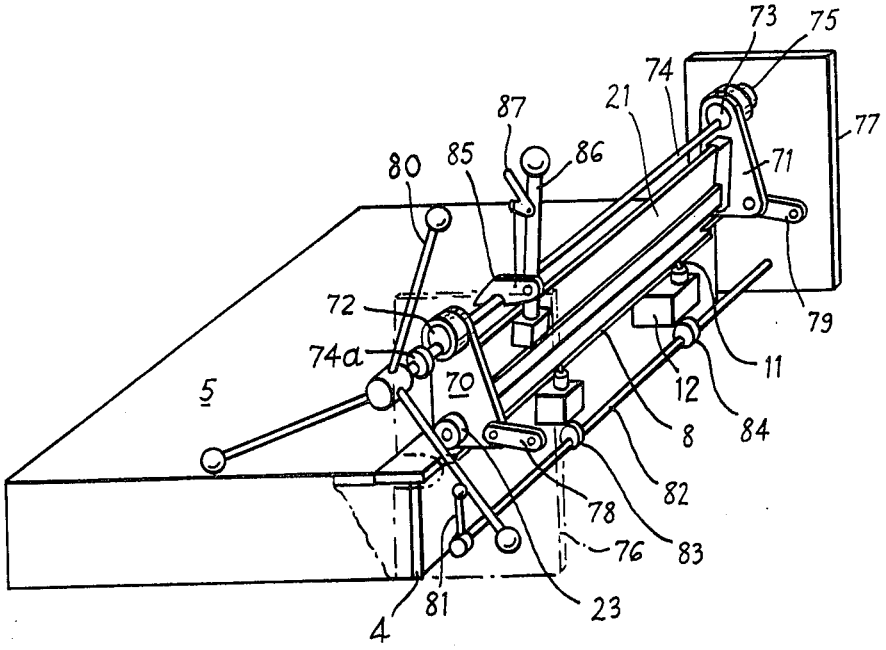
FIG. 10 is a perspective view of yet another embodiment In the drawings the same reference characters have been used to designate the same or similar parts.

Referring now to FIG. 10, this shows a manually operated edge-forming apparatus in which the former plate 5 has only one die part, namely the die part 8 which constitutes the right-hand edge, as illustrated, of the former plate. The former plate 5 is mounted on a table 4 forming with end panels 76, 77 secured to the table, a supporting structure, the panel 76 being partly cut away where shown in dash-dotted lines. The end panels 76, 77 constitute the frame of the apparatus or may be mounted on a frame similar to the frame 1 of FIGS. 1 to 3.

The apparatus also has the register pins 11 for locating a lithographic plate on the former plate 5, the pins 11 being mounted in housings 12 secured to one side of the table 4 adjacent the die part 8. The register pins for the opposite side of the table are not shown. The register pins 11 are advanced to engage in register pin holes in the lithographic plate and retracted therefrom by means of cams 83 and 84 co-operating with the register pins 11 and mounted on a shaft 82 which is rotatable by a handle 81.

Generally triangular levers in the form of cam plates 70 and 71 which function as double-armed levers in a similar manner to the bell-crank levers of the embodiments of FIGS. 1 to 3 and 7 to 9 are provided with cams 72, 73 rotatably mounted therein. The cams 72, 73 are fixed eccentrically to a shaft 74 passing through the upper apices or part of one of the arms of the cam plate. The shaft 74 is carried in bearings 74*a* 75 in the end plates 76, 77. In order to locate the cam plates 70, 71 and prevent them from rotating around the shaft 74, links 78, 79 are connected between the right hand apices or other arms of the cam plates 70, 71 and the end plates 76, 77.

Extending between the cam plates 70, 71 is the forming beam 21 of the FIGS. 1 to 3 and 7 to 9 embodiments. The beam 21 is pivotally connected to the cam plates by means of the pivots 23 to be rotatable about a substantially horizontal axis extending through the centres of the pivots and parallel to the die part 8. By means of a handle 80 secured to one end of the shaft 74, the latter is rotated causing the cams 72, 73 to be rotated and thereby act to force the cam plates 70, 71 downwards and press the pad 26 against the former plate. A lever 86 which performs an equivalent to the piston and cylinder device 36 of FIGS. 1 to 3 and 7 to 9 and which rotates the beam about the common axis of the pivot 23 is fixed to the beam 21. The lever 86 is maintained in the illustrated position by means of a catch plate 85 engaged with the shaft 74, the catch plate being releasable by lever 87 to enable the lever 86 to be rotated. The operation of the apparatus of FIG. 10 can also be described with reference to FIGS. 4A to 4E. Firstly a lithographic plate 6 is mounted on the former plate 5 as described with reference to FIG. 4*a*, with its edges 6*a* projecting beyond the die part 8 and the other edge of the former plate respectively. By rotating the handle 81 in the appropriate direction, the register pins 11 are engaged in the register pin holes to locate the plate 6 on the former plate 5. The handle 80 is then turned in the appropriate direction to cause the cam plates to move the forming beam 21 downwards so that the pad 26 clamps the plate to the former plate as shown in FIG. 4*a*. The handle 81 is then rotated in the opposite direction to retract the pins 11, as shown in FIG. 4*b*, the lever 87 is moved to release the lever 86 which is then rotated to turn the pad 26 about the die part 8 to edge-form the plate 6, as shown in FIG. 4*c*. The sequence of operations is then reversed through the steps shown in FIGS. 4*d* and 4*e* by returning the lever to the illustrated position with the catch 85 engaged and then rotating the handle 80 to raise the forming beam 21. The lithographic plate 6 having one edge formed, i.e. the right hand edge as illustrated in FIG. 4*g* can then be removed by hand from the former plate.

If required, the plate 6 can be turned around and the opposite edge of the plate 6 edge-formed in the manner previously described. If this is the case or if the apparatus is adapted to edge-form two opposite edges of a lithographic plate, employing similar edge-forming apparatus and die parts at the left hand edge as illustrated of the former plate, then a manually operated wedge system could be included to reduce the dimension of the former plate between the opposite formed edges, as shown in FIG. 4*f*.

The wedge system would be the same as the wedge system 28 illustrated in FIGS. 5 and 6 except that a handle would replace the piston and cylinder device 30.

Whilst particular embodiments have been described, various modifications may be made without departing from the scope of the invention. For example, the die part 8 may be replaced by the die parts having only one bend, additional bending apparatus may be provided to provide the second bend instead of the die parts which provide only one bend.

To form plates on one edge only of the plates or when the angles of bend are less than 90° on one or both edges with the apparatus of FIGS. 1 to 3 and 7 to 9, the pneumatically operated wedge may be dispensed with and a conventional pusher means used to remove the edge-formed plate from the former plate 5. Moreover, in the case where the apparatus comprises only one set of bell-crank levers and beams, the wedge may also be dispensed with since there is no need to reduce the width of the table when one edge only is formed.

The piston and cylinder devices of the apparatus of FIGS. 1 to 3 and 7 to 9 may be hydraulically operated or replaced by other mechanisms such as mechanical linkages or electrically operated means such as solenoids or servo-motors.

Furthermore, any of the apparatus described may be adapted to form the edges of the metallic plate upwardly around the die parts 7 or 8 instead of downwardly as described.

The former edge or edges of the plate may comprise angle(s), bend(s), curve(s) and/or shape(s) which are different to that described.

I claim:

1. Apparatus for edge-forming a metallic printing plate, said apparatus comprising, in combination:

a. a supporting structure, b. a former mounted on said supporting structure and having, i. a surface for receiving the printing plate and ii. at least one first die part constituted by a side edge of said former, having a portion which is inclined inwardly at an angle of greater than 90° with respect to said receiving surface, c. means for locating the printing plate on said former with an edge thereof to be formed projecting beyond said first die part, d. means for forming at least one bend in said projecting edge of said printing plate by bending said projecting edge around said first die part, including i. at least one second die part comprising a pad made of a flowable resilient material and ii. and elongate member having a channel therein in which said pad is mounted, said elongate member extending parallel to said first die part, e. at least one pair of bell-crank levers carrying said elongate channel member therebetween, for pressing the pad against the printing plate and thus the printing plate against the former, f. first pivot means mounting said bell-crank levers on said supporting structure to be pivotable about a substantially horizontal axis, g. second pivot means mounting said elongate channel member on said bell-crank levers, for rotation about a substantially horizontal axis on, and with respect thereto, h. first power means for pivoting said bell-crank levers between a position in which the said pad is pressed against said printing plate and said former adjacent the projecting edge of said printing plate to clamp said printing plate to said former, and a non-clamping position in which the pad is spaced from said printing plate, i. second power means for rotating said elongate channel member to turn said pad around said first die part and bend the projecting edge of said printing plate around said first die part whilst said bell-crank levers press and maintain said pad in contact with the printing plate at the bending angle, and throughout the entire area, of the bend, whereby to cause the material of said pad and thus the projecting edge of said printing plate to conform to the shape of said first die part and to control the inside radius of the bend.

2. Apparatus as claimed in claim 1 wherein the material of the said pad is a selected from the group comprising urethane rubbers and urethane elastomers.

3. Apparatus as claimed in claim 1, including means for reducing the dimension of the former between the first die part and the opposite edge of the former.

4. Apparatus as claimed in claim 1, including means for automatically removing an edge-formed metallic plate from the former, comprising a plurality of wheels rotatably mounted on a frame supported beneath the former, said frame being movable into a position in which the wheels project beyond the plate receiving surface of the former through respective apertures therein, means operative to effect rotation of said wheels when the frame occupies said position, and two rotatable shafts carrying eccentrics by means of which the frame is supported on said shafts to be movable with respect to said shafts into its said position by the action of said eccentrics when said shafts are rotated.

5. Apparatus as claimed in claim 4, wherein a wedge system is provided to reduce the dimension of the former between the first die part and the opposite edge of the former and common drive means are provided for effecting displacement of the wedges of said system and the movement of said frame.

6. Apparatus as claimed in claim 5, wherein said common drive means is connected to said rotatable shafts by a linkage.

7. Apparatus as claimed in claim 6, including a motor carried by the frame, for rotating the wheels, said motor having a switch which is operable by the action of the drive means to switch-on the motor when the frame is in its said position and switch-off the motor when the frame is moved out of its said position.

8. Apparatus as claimed in claim 7, wherein the common drive means is a pressure fluid operated double acting piston and cylinder device having a piston rod connected to said linkage, and wherein the movement of the piston rod actuates the motor switch.

9. Apparatus as claimed in claim 1, wherein said first and second power means comprise double-acting pressure-fluid operated piston and cylinder devices acting between said supporting structure and said bell-crank levers and between said supporting structure and elongate channel member.

10. Apparatus as claimed in claim 1, wherein the means for locating the said printing plate include a plurality of register pins which co-operate with register pin holes provided in the projecting edge of said printing plate, and means for extending said register pins beyond said receiving surface of said former so that the holes in said printing plate can be engaged therewith and for retracting the pins below the former to disengage the register pins from said holes.

11. Apparatus as claimed in claim 10, wherein the means for extending and retracting said register pins comprise double-acting pressure fluid operated piston and cylinder devices.

12. Apparatus for edge-forming a metallic printing plate, said apparatus comprising, in combination:

a. a supporting structure, b. a former mounted on said supporting structure and having, i. a surface for receiving the printing plate and ii. at least one first die part constituted by a side edge of said former, having a portion which is inclined inwardly at an angle of greater than 90° with respect to said receiving surface, c. means for locating the printing plate on said former with an edge thereof to be formed projecting beyond said first die part, d. means for forming at least one bend in said projecting edge of said printing plate by bending said projecting edge around said first die part, including
   i. at least one second die part comprising a pad made of a flowable resilient material and
   ii. an elongate member having a channel therein in which said pad is mounted, said elongate member extending parallel to said first die part,
e. at least one pair of generally triangular plates serving as double-armed levers carrying said elongate channel member therebetween, for pressing the pad against the printing plate and thus the printing plate against the former,
f. a pair of links pivotally connecting said plates to the supporting structure,
g. pivot means mounting said elongate channel member on said plates, for rotation about a substantially horizontal axis on, and with respect thereto,
h. means for moving said plates between a position in which the said pad is pressed against said printing plate and said former adjacent the projecting edge of said printing plate to clamp said printing plate to said former, and a non-clamping position in which the pad is spaced from said printing plate, including
   i. a shaft rotatably mounted on said supporting structure and extending parallel to said elongate member,
   ii. a pair of cams fixed eccentrically to said shaft for rotation therewith and rotatably mounted in said pair of plates respectively, and
   iii. and means for rotating the shaft to move said plates
i. means for releasably securing said channel member to said plates to move therewith, and
j. lever means for rotating said elongate channel member to turn said pad around said first die part and bend the projecting edge of said printing plate around said first die part whilst said plates press and maintain said pad in contact with the printing plate at the bending angle, and throughout the entire area, of the bend, whereby to cause the material of said pad and thus the projecting edge of said printing plate to conform to the shape of said first die part and to control the inside radius of the bend.

13. Apparatus as claimed in claim 12, wherein the material of the said pad is selected from the group comprising urethane rubbers and urethane elastomers.

14. Apparatus as claimed in claim 12, wherein the means for locating said printing plate comprises a plurality or register pins which co-operate with register pin holes provided in the projecting edge of said printing plate, and means including a plurality of cams mounted on a rotatable shaft, to extend said register pins beyond said receiving surface of said former so that the holes in the printing plate can be engaged therewith and to retract the pins below the former to disengage the register pins from said holes.

15. A method of edge-forming a metallic plate, said method comprising the steps of:
a. providing a metallic printing plate having register pin holes along at least one of its edges,
b. mounting said printing plate on a former having at least one side edge formed with a portion which is inclined inwardly at an angle of greater than 90° with respect to the printing plate, such that said at least one edge of the printing plate projects beyond said side edge of said former and the register pin holes engage with register pins projecting beyond the upper surface of said former, to locate said printing plate on said former,
c. pivoting an elongate die pad made of a resilient flowable material about a substantially horizontal axis and into contact with the printing plate at a location adjacent its projecting edge such that a front edge of said pad presses against the printing plate and clamps it to said former and a rear edge of said pad is located just above and clears said register pins,
d. retracting said register pins from the register pin holes in said printing plate, into a position below said former, and
e. turning said die pad around said side edge of said former in contact with the projecting edge of said printing plate to form at least one bend therein whilst simultaneously maintaining said clamping pressure and contact between the printing plate and said pad at the bending angle and throughout the entire area of the bend, whereby to cause the material of said pad and thus the projecting edge of said printing plate to conform with the shape of the side edge of said former, and to control the inside radius of the bend.

* * * * *